US006577057B1

(12) United States Patent
Yamamoto et al.

(10) Patent No.: US 6,577,057 B1
(45) Date of Patent: Jun. 10, 2003

(54) DISPLAY AND METHOD OF MANUFACTURE

(75) Inventors: Joyce K. Yamamoto, Chandler, AZ (US); Emmett M. Howard, Gilbert, AZ (US); Lawrence N. Dworsky, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 234 days.

(21) Appl. No.: 09/656,644

(22) Filed: Sep. 7, 2000

(51) Int. Cl.[7] ..... H01J 29/86; H01J 31/12

(52) U.S. Cl. ..... 313/495; 313/497; 313/496; 313/581

(58) Field of Search ..... 313/495, 461, 313/496, 497, 581, 309, 336, 351, 306

(56) References Cited

U.S. PATENT DOCUMENTS

| | | | | |
|---|---|---|---|---|
| 5,397,957 A | | 3/1995 | Zimmerman | |
| 5,465,024 A | | 11/1995 | Kane | |
| 5,541,473 A | | 7/1996 | Duboc, Jr. et al. | |
| 5,589,731 A | | 12/1996 | Fahlen et al. | |
| 5,597,518 A | | 1/1997 | Lovoi | |
| 5,644,327 A | | 7/1997 | Onyskevych et al. | |
| 5,667,418 A | | 9/1997 | Fahlen et al. | |
| 5,672,083 A | | 9/1997 | Curtin et al. | |
| 5,674,351 A | | 10/1997 | Lovoi | |
| 5,686,790 A | | 11/1997 | Curtin et al. | |
| 5,727,977 A | | 3/1998 | Maracas et al. | |
| 5,798,604 A | | 8/1998 | Duboc, Jr. et al. | |
| 5,872,420 A | * | 2/1999 | Itih et al. | 313/495 X |
| 5,880,705 A | | 3/1999 | Onyskevych et al. | |
| 5,949,185 A | * | 9/1999 | Janning | 313/495 |
| 5,962,969 A | * | 10/1999 | Watkins | 313/495 |

* cited by examiner

*Primary Examiner*—Ashok Patel
(74) *Attorney, Agent, or Firm*—William E. Koch; Kevin D. Wills

(57) ABSTRACT

A field emissive display (40) having an anode plate (10) coupled to a cathode plate (20) and a method for manufacturing the field emissive display (40). A substrate (21) of the cathode plate (20) is manufactured or selected such that its coefficient of thermal expansion substantially matches that of the anode plate (10), i.e., the coefficients of thermal expansion of the cathode plate (20) and the anode plate (10) are within ten percent of each other. The cathode plate (20) is coupled to the anode plate (10) by means of a frit structure (41) whose coefficient of thermal expansion preferably substantially matches that of the cathode plate (20) and the anode plate (10). A control circuit can be mounted to the bottom surface of the field emissive display (40).

18 Claims, 2 Drawing Sheets

DISPLAY AND METHOD OF MANUFACTURE

FIELD OF THE INVENTION

The present invention relates, in general, to emissive devices and, more particularly, to displays such as field emissive displays, electroluminescent displays, liquid crystal displays, and plasma displays and methods of manufacturing field emissive devices used in the displays.

BACKGROUND OF THE INVENTION

Field emissive displays are well known in the art. A field emissive display includes an anode plate and a cathode plate that define a thin envelope. Typically, the anode plate and the cathode plate are thin enough to necessitate some form of spacer structure to prevent implosion of the device due to the pressure differential between the internal vacuum and external atmosphere. The spacers are disposed within the active area of the device, which includes the electron emitters and phosphors.

Currently, the anode and cathode plates are made from glass substrates having a maximum processing temperature of 600 degrees Celsius. The temperature limitation does not pose a severe limitation on the operation of the displays because they are typically operated at temperatures below 200 degrees Celsius. However, they do limit the types of anode and cathode structures that can be manufactured on the glass substrates to those manufactured at temperatures below 600 degrees Celsius.

Accordingly, it would be advantageous to have a field emissive display and method for manufacturing the field emissive display that mitigates the constraints introduced by high temperature manufacturing processes.

BRIEF DESCRIPTION OF THE DRAWINGS

For simplicity and clarity of illustration, elements in the drawings are not necessarily drawn to scale, and the same reference numerals in different figures denote the same elements.

DETAILED DESCRIPTION OF THE DRAWINGS

Generally, the present invention provides a display and a method for manufacturing the display. Displays suitable for manufacture in accordance with the present invention include plasma displays, electroluminescent displays, liquid crystal displays, and the like. In accordance with various embodiments of the present invention, the coefficient of thermal expansion of the cathode plate substantially matches that of the anode plate. An advantage of matching the coefficient of thermal expansion of the cathode plate to that of the anode plate is that it opens up the range of processes for forming the cathode structure to those at higher temperature ranges. Thus, the cathode plate can comprise wells, vacuum bridges, planar gates, or other three-dimensional structures that are typically manufactured at temperatures greater than 600 degrees Celsius. Generally, the coefficient of thermal expansion of the substrate material of the anode plate limits the processing and operational temperatures of the field emissive display. Because the cathode plate of the present invention can withstand much higher processing temperatures, it can be subjected to more extreme processing conditions prior to being coupled to the anode plate. In addition, matching the coefficient of thermal expansion of the cathode plate to the anode plate maintains process stability and robustness as well as product viability.

Figure 1:
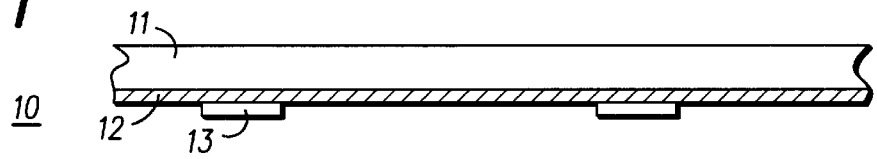
FIG. 1 is a highly enlarged cross-sectional view of an anode plate in accordance with an embodiment of the present invention.

Now referring to FIG. 1, what is shown is a cross-sectional view of an anode plate 10. Anode plate 10 includes a transparent substrate 11 made from, for example, borosilicate glass or soda lime glass. It should be understood the type of material for substrate 11 is not a limitation of the present invention, i.e., substrate 11 can be a transparent glass or a transparent non-glass material. An anode 12 is disposed on transparent substrate 11. Anode 12 is preferably made from a transparent conductive material such as, for example, indium tin oxide. A plurality of phosphors 13 is disposed on anode 12. Methods for fabricating anode plates are known to one skilled in the art. By way of example, substrate 11 has a coefficient of thermal expansion of approximately 3.8× 10-6 per degree Celsius.

Figure 2:
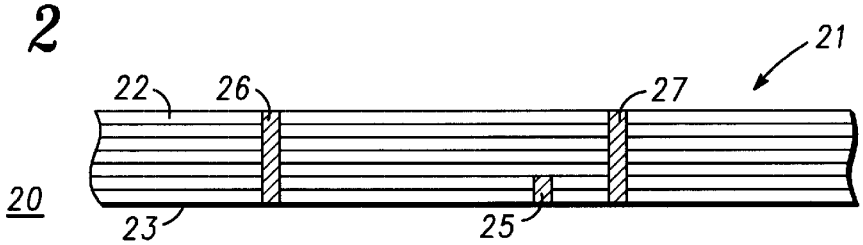
FIG. 2 is a highly enlarged cross-sectional view of a cathode plate at a beginning stage of manufacture in accordance with an embodiment of the present invention.

FIG. 2 is a cross-sectional view of a portion of a cathode plate 20 at a beginning stage of manufacture in accordance with an embodiment of the present invention. What is shown in FIG. 2, is a Multi-Layer Co-fired Ceramic (MLCC) substrate 21 having a major surface 22, a major surface 23, and a plurality of metal-filled vias 25, 26, and 27. Multi-layered ceramic substrates consist of thin sheets of ceramic, glass ceramic, glass, insert or catalytic fillers mixed together in any combination, stacked together, pressed and heated to the appropriate temperatures to form a dense solid body. By way of example, substrate 21 has seven layers including layers 18 and 19, wherein each layer has a thickness of 1.42 millimeters (approximately 8 mils). It should be understood that the exposed surface of layer 18 serves as bottom surface 23 of substrate 21 and the exposed surface of layer 19 serves as top surface 22 of substrate 21.

The use of multiple ceramic layers allows tailoring the coefficient of thermal expansion and the dielectric constant of substrate 21. By way of example, the coefficient of thermal expansion of substrate 21 is 3.8×10-6 per degree Celsius. In accordance with one embodiment of the present invention, substrate 21 has a coefficient of thermal expansion within ten percent of the coefficient of thermal expansion of substrate 11. In accordance with another embodiment of the present invention, substrate 21 has a coefficient of thermal expansion within five percent of the coefficient of thermal expansion of substrate 11. In accordance with yet another embodiment of the present invention, substrate 21 has a coefficient of thermal expansion within one percent of the coefficient of thermal expansion of the substrate 11. Methods for manufacturing substrate 21 having vias 25, 26, and 27 are known to those skilled in the art. Although substrate 21 is described as an MLCC substrate, it should be understood this is not a limitation of the present invention. For example, substrate 21 can be glass ceramic, pressed, rolled, extruded, etc.

Figure 3:
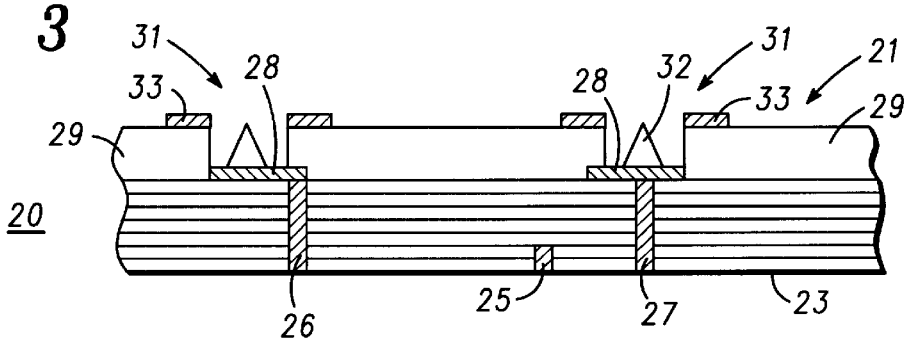
FIG. 3 is a highly enlarged cross-sectional view of the cathode plate of FIG. 2 further along in manufacture.

FIG. 3 is a cross-sectional view of the portion of cathode plate 20 at a later stage of manufacture. In particular, cathode plate 20 includes a conductive pad 28 disposed on surface 22. A dielectric layer 29 is disposed on conductive pad 28 and further defines a plurality of wells 31. An electron emitter 32 is formed in each of wells 31. The material of the electron emitter is not a limitation of the present invention. For example, other suitable materials for electron emitter 32 include nanotubes, nanocorraline, diamond like carbon, diamond, field emitting inks, metal foils, metal tips, amorphous carbon, and amorphous diamond.

As those skilled in the art are aware, a plurality of conductive pads are typically formed on substrate 21 and when electrically connected form the column of a field emissive display. Similarly, a plurality of conductive rows 33 is formed on dielectric layer 29 and serve as the rows of the field emissive display. Conductive columns 28 and conductive rows 32 are used to selectively address electron emitters 32.

Figure 4:
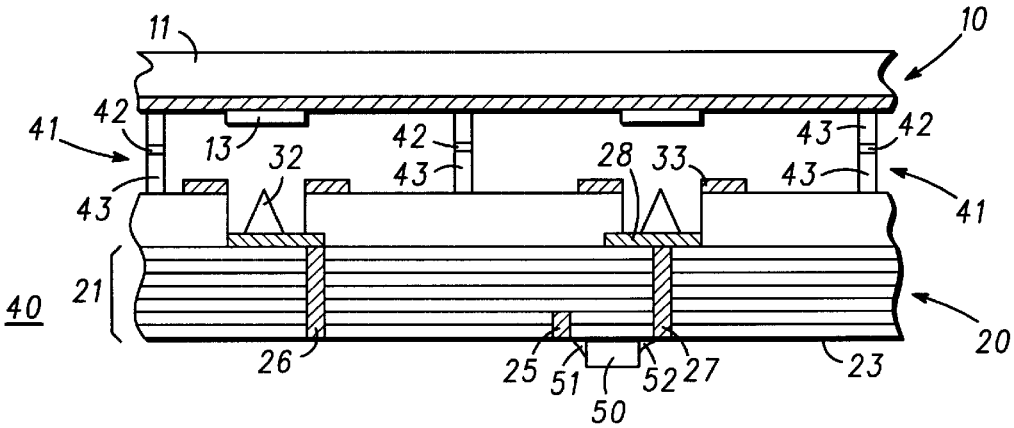
FIG. 4 is a highly enlarged cross-sectional view of a field emissive display in accordance with an embodiment of the present invention.

FIG. 4 is a cross-sectional view of a field emissive display 40 in accordance with an embodiment of the present invention. Field emissive display 40 comprises anode plate 10 coupled to cathode plate 20 by means of a coupling structure 41. By way of example, frit structure 41 is comprised of a frit frame 42 having opposing surfaces. A glass frit 43 is disposed on each opposing surface of frit frame 42, thereby forming coupling structure 41. Anode plate 10, cathode plate 20, and coupling structure 41 are then placed in a vacuum oven and bonded together to form field emissive display 40. An advantage of the present invention is that the coefficients of thermal expansion of cathode plate 20 and coupling structure 41 substantially match that of anode plate 10, thereby preventing implosion or seal delamination when field emissive display 40 is cooled and removed from the vacuum oven.

Although coupling structure 41 is described as including a glass frit disposed on a frit frame, it should be understood this is not a limitation of the present invention. For example, coupling structure 41 may be a glass frit-base without the use of a frit frame. Similarly, coupling structure 41 can be formed from a metal based technology which may include tubulation, i.e., sealing in atmosphere with post seal evacuation.

In accordance with this embodiment, a control circuit 50 having control electrodes 51 and 52 is coupled to metal filled vias 25 and 27. It should be understood that the location at which control circuitry such as control circuit 50 is coupled to the field emissive display is not a limitation of the present invention. For example, control circuit 50 could be coupled to surface 22 or could be detached from field emissive display 40.

Figure 5:
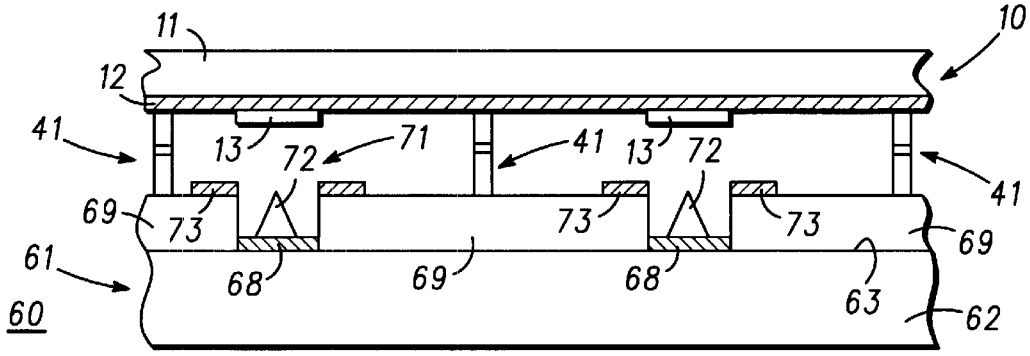
FIG. 5 is a cross-sectional view of a field emissive display in accordance with another embodiment of the present invention.

FIG. 5 is a cross-sectional view of a field emissive display 60 in accordance with another embodiment of the present invention. Field emissive display 60 comprises anode plate 10 coupled to cathode plate 61 by means of coupling structure 41. In the embodiment illustrated in FIG. 5, substrate 62 of cathode plate 61 is a plate glass that has been subjected to a thermal treatment to induce crystal growth and set the coefficient of thermal expansion such that it matches the coefficient of thermal expansion of substrate 11. Similar to cathode plate 20 (FIG. 4), conductive pads 68 are disposed on a surface 63 of substrate 62. A dielectric layer 69 is disposed on conductive pad 68 and further defines a plurality of wells 71. An electron emitter 72 is formed in each of wells 71. Although only a single conductive pad 68 is shown, it should be understood this is not a limitation of the present invention. As those skilled in the art are aware, a plurality of conductive columns are typically formed on substrate 62 and serve as the columns of a field emissive display. Similarly, a plurality of conductive rows 73 is formed on dielectric layer 69 and serve as the rows of the field emissive display. Conductive columns 68 and conductive rows 72 are used to selectively address electron emitters 72. It should be noted in this embodiment, the control circuit (not shown) can be coupled to surface 63 of substrate 62 or, alternatively, it can be detached from substrate 62. Anode plate 10, cathode plate 61, and frit structure 41 are then placed in a vacuum oven and bonded together to form field emissive display 60. It should be understood that the method and time for bonding anode plate 10, cathode plate 61, and frit structure 41 together, i.e., sealing the package, is not a limitation of the present invention.

Figure 6:
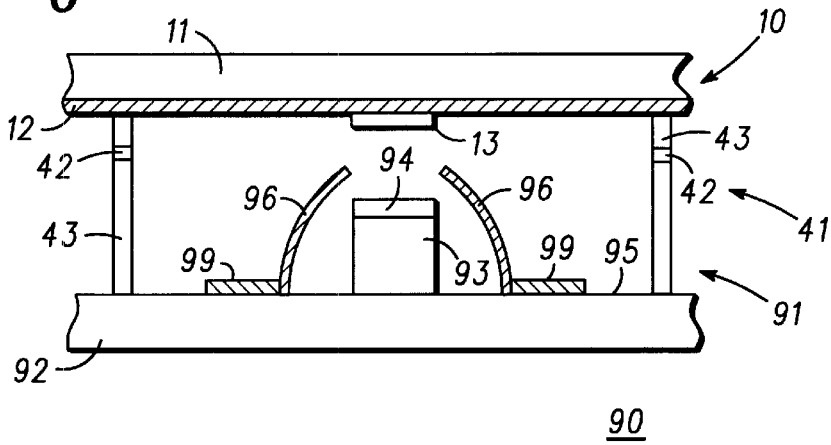
FIG. 6 is a cross-sectional view of a field emissive display in accordance with yet another embodiment of the present invention.

FIG. 6 is a cross-sectional view of a vacuum bridge field emissive display 90 in accordance with another embodiment of the present invention. Vacuum bridge field emissive displays are described in a U.S. patent application having attorney docket number FD20018, entitled "TITLE," and invented by "NAME," and which is incorporated by reference herein in its entirety. Vacuum bridge field emissive display 90 comprises anode plate 10 coupled to cathode plate 91 by means of coupling structure 41. In the embodiment illustrated in FIG. 6, substrate 92 of cathode plate 91 is a plate glass that has been subjected to a thermal treatment to induce crystal growth and set the coefficient of thermal expansion such that it matches the coefficient of thermal expansion of substrate 11.

A cathode 93 having an emissive material 94 disposed thereon is formed on a surface 95 of substrate 92. A gate structure 96 surrounds cathode 93. A biasing means (not shown) is used to bias cathode 93. Emission of electrons from emissive material 94 is controlled by gate structure 96. Control signals are transmitted to gate structure 96 by means of electrodes 99. Although only one cathode 93 and one gate structure 96 is shown, it should be understood that typically a plurality of cathodes 93 and gate structures 96 are formed on substrate 92. Gate structures 96 are connected to form columns and cathodes 93 are connected to form rows so that individual addressing to each subpixel is possible.

Although not shown, a control circuit can be coupled to surface 95 of substrate 92 or, alternatively, it can be detached from substrate 92. Anode plate 10, cathode plate 91, and frit structure 41 are then placed in a vacuum oven and bonded together to form field emissive display 90. It should be understood that the method and time for bonding anode plate 10, cathode plate 91, and frit structure 41 together, i.e., sealing the package, is not a limitation of the present invention.

Figure 7:
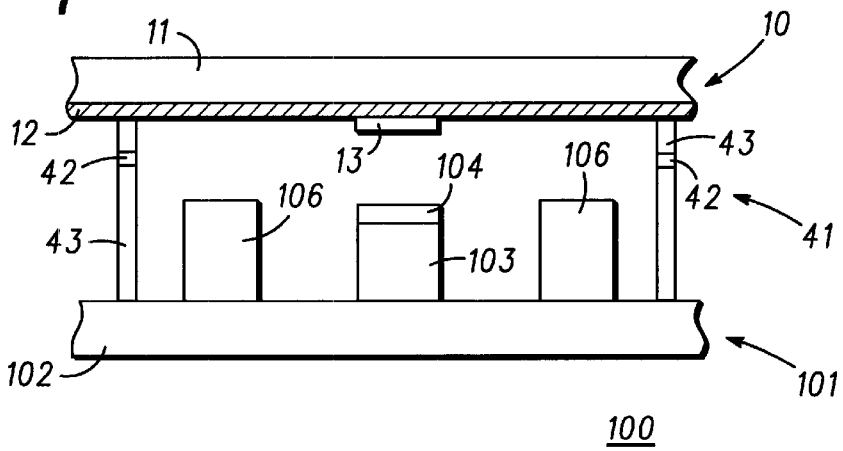
FIG. 7 is a cross-sectional view of a field emissive display in accordance with yet another embodiment of the present invention.

FIG. 7 is a cross-sectional view of a planar gate field emissive display 100 in accordance with another embodiment of the present invention. Planar gate field emissive display 100 comprises anode plate 10 coupled to cathode plate 101 by means of coupling structure 41. In the embodiment illustrated in FIG. 7, substrate 102 of cathode plate 101 is a plate glass that has been subjected to a thermal treatment to induce crystal growth and set the coefficient of thermal expansion such that it matches the coefficient of thermal expansion of substrate 11.

A cathode 103 having an emissive material 104 disposed thereon is formed on a surface of substrate 102. Gate structures 106 surrounds cathode 103. A biasing means (not shown) is used to bias cathode 103. Emission of electrons from emissive material 104 is controlled by gate structure 106. Although only one cathode 103 and two gate structures 106 are shown, it should be understood that typically a plurality of cathodes 103 and gate structures 106 are formed on substrate 102. Gate structures 106 are connected to form columns and cathodes 103 are connected to form rows so that individual addressing to each subpixel is possible.

Alternatively, glass substrates 62, 92, and 102 can be formed by plate glass methods (e.g. float glass) followed by a post-forming thermal treatment to crystallize out the desired ceramic phase or phases, producing the desired coefficient of thermal expansion.

By now it should be appreciated that a field emissive display having cathode and anode plates with matching coefficients of thermal expansion and a method for manufacturing the field emissive device have been provided. Matching the coefficients of thermal expansion of the cathode and anode plates improves the reliability of the field emissive display and allows operating the field emissive display at higher temperatures. Preferably, the coefficient of thermal expansion of the structure coupling the cathode and anode plates together also has substantially the same coefficient of thermal expansion as the cathode and anode plates. Another advantage of the cathode plate of the present invention is that it can be subjected to much higher processing temperatures than the anode, i.e., the cathode can be subjected to temperatures from 600 degrees Celsius to as high as 1,800 degrees Celsius. A nominal range of temperatures to which the cathode plate can be subjected is between 600 degrees Celsius and 1,200 degrees Celsius. A common temperature range to which the cathode plate can be subjected is 600 degrees Celsius to 900 degrees Celsius. The higher temperatures allow forming electron emitter structures such as triode and diode structures using wells, planar, seam or crack (electron hopping), elevated gate, elevated grid, co-planar, Spindt tips or cones, knife edge emitters, and narrow rod. Other benefits of the present invention include mitigation of delamination of the seal material from the anode plate or the cathode plate as well as the seal failure due to constant exposure to temperature cycling or vibration that will cause the seal to fail. Another benefit of the present invention is that control circuitry can be formed on either the bottom and top surfaces or away from the cathode plate substrate.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention. For example, the cathode plate may be made of a glass that is able to withstand higher temperatures while still having its coefficient of thermal expansion matched to the anode glass, but is not visually transparent; and therefore cannot be used as the anode plate. Likewise, the present invention includes the use of glass or ceramic that has a coefficient of thermal expansion matching that of the anode plate while being stable at temperatures greater than 600 degrees Celsius. Further, the present invention can also include gettering structures.

What is claimed is:

1. A display, comprising:

a first substrate which includes a plurality of ceramic layers, the first substrate having first and second major surfaces and a first coefficient of thermal expansion;

wherein the first coefficient of thermal expansion is substantially determined by choosing at least one of the number of layers in the plurality of ceramic layers, the material composition of a layer in one of the plurality of ceramic layers, and the physical dimension of a layer in at least one of the plurality of ceramic layers;

an electron emission structure disposed on the first major surface of the first substrate;

a second substrate having first and second major surfaces and a second coefficient of thermal expansion, wherein the second substrate is coupled to the first substrate and the first and second coefficients of thermal expansion are within 10 percent of each other; and an electron target disposed on the first major surface of the second substrate.

2. The display of claim 1, wherein the first substrate is selected from the group consisting of ceramic, glass, glass ceramic.

3. The display of claim 1, wherein the second substrate comprises one of borosilicate glass or a transparent material.

4. The display of claim 1, wherein the first substrate comprises a multi-layer co-fired ceramic.

5. The display of claim 4, further including at least one filled via extending from the second major surface of the first substrate.

6. The display of claim 1 wherein the coefficient of thermal expansion of the first and second substrates is approximately 3.8×10−6 per degree Celsius.

7. The display of claim 1, further including one of a metal seal or a frit glass between the first and second substrates.

8. The display of claim 7, wherein the frit glass is mounted to a frit frame.

9. The display of claim 7, wherein a coefficient of thermal expansion of the first glass is within 10 percent of the first and second coefficients of thermal expansion.

10. The display of claim 1, wherein the first and second coefficients of thermal expansion are within 5 percent of each other.

11. The display of claim 1, wherein the first and second coefficients of thermal expansion are within 1 percent of each other.

12. A display, comprising:

a cathode plate with a first coefficient of thermal expansion and a plurality of ceramic layers wherein the first coefficient of thermal expansion is obtained by choosing at least one of a number of ceramic layers included in the cathode plate, the material properties of at least one of the plurality of ceramic layers, and the physical dimensions of at least one of the plurality of ceramic layers;

a plurality of electron emitters disposed on the cathode plate wherein the plurality of electron emitters are formed at a temperature within a range from 600 degrees Celsius to 1800 degrees Celsius; and an anode plate having phosphor disposed thereon, the anode plate having a second coefficient of thermal expansion, wherein a value of the first coefficient of thermal expansion is within 10 percent of a value of the second coefficient of thermal expansion.

13. The display of claim 12, wherein the cathode plate comprises a multi-layer co-fired ceramic.

14. The display of claim 12, wherein the cathode plate further includes a via extending from the first major surface.

15. The display of claim 12, wherein the cathode plate comprises a material selected from the group of ceramic, glass ceramic, fillers, or combinations thereof.

16. The display of claim 12, wherein the anode plate comprises borosilicate.

17. The display of claim 12, wherein the cathode plate is coupled to the anode plate by means of a frit material or a metal seal.

18. The display of claim 17, wherein the cathode plate, the anode plate, and the frit material cooperate to form a display selected from the group including plasma displays, electroluminescent displays, liquid crystal displays, and the like.

* * * * *